US008960434B2

(12) United States Patent
Hu

(10) Patent No.: US 8,960,434 B2
(45) Date of Patent: Feb. 24, 2015

(54) PACKAGE STRUCTURE OF LIQUID CRYSTAL DISPLAY MODULE

(71) Applicant: Shenzhen China Star Optoelectronics Technology Co., Ltd., Shenzhen, Guangdong (CN)

(72) Inventor: Qianshuang Hu, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 8 days.

(21) Appl. No.: 13/703,957

(22) PCT Filed: Oct. 11, 2012

(86) PCT No.: PCT/CN2012/082739

§ 371 (c)(1),
(2) Date: May 14, 2013

(87) PCT Pub. No.: WO2014/047970

PCT Pub. Date: Apr. 3, 2014

(65) Prior Publication Data

US 2014/0083901 A1 Mar. 27, 2014

(51) Int. Cl.

| | |
|---|---|
| ***B65D 85/48*** | (2006.01) |
| ***B65D 81/02*** | (2006.01) |
| ***B65D 81/05*** | (2006.01) |
| ***B65D 81/113*** | (2006.01) |
| ***B65D 57/00*** | (2006.01) |

(52) U.S. Cl.

CPC ..... *B65D 81/051* (2013.01); *B65D 81/113* (2013.01); *B65D 85/48* (2013.01); *B65D 57/00* (2013.01)

USPC ..... 206/454; 206/522

(58) Field of Classification Search

USPC ..... 206/448–455, 522, 593, 701

See application file for complete search history.

(56) References Cited

U.S. PATENT DOCUMENTS

| | | | | |
|---|---|---|---|---|
| 4,202,452 | A * | 5/1980 | McCormick | 206/454 |
| 7,681,376 | B2 * | 3/2010 | Hirata et al. | 206/521 |
| 2004/0226845 | A1 * | 11/2004 | Raj | 206/454 |
| 2014/0076775 | A1 * | 3/2014 | Kuo et al. | 206/725 |

FOREIGN PATENT DOCUMENTS

| | | | |
|---|---|---|---|
| CN | 2741902 | Y | 11/2005 |
| CN | 201121002 | Y | 9/2008 |
| JP | 2003-72845 | A | 3/2003 |
| JP | 2003-200974 | A | 7/2003 |
| TW | M341003 | U | 9/2008 |

* cited by examiner

*Primary Examiner* — Bryon Gehman

(74) *Attorney, Agent, or Firm* — Andrew C. Cheng

(57) ABSTRACT

The present invention provides a liquid crystal display module packaging structure, which includes a package box and a cushioning device received in the package box. The cushioning device includes a bottom cushioning piece and a top cushioning piece used in combination with the bottom cushioning piece. The bottom cushioning piece includes a cushioning bottom board, two cushioning side boards mounted to the cushioning bottom board and arranged at two ends of the cushioning bottom board, and three positioning boards mounted to the cushioning bottom board and arranged, in a spaced manner, between the two cushioning side boards. The cushioning side boards and the positioning boards form therein first and second accommodation spaces. The first and second accommodation spaces are filled with a plurality of inflatable cushioning bodies.

9 Claims, 5 Drawing Sheets

PACKAGE STRUCTURE OF LIQUID CRYSTAL DISPLAY MODULE

BACKGROUND OF THE INVENTION

1. Field of the Invention

The present invention relates to the field of packaging, and in particular to a package structure of liquid crystal display module.

2. The Related Arts

The products of electronic industry are characterized by being complicated, high value, and fast innovation. A complicated supply chain is often present between manufacturers. For the current style of production and sales of electronic products, the manufacture, assembling, and sales are generally done at different sites. This requires components and semi-finished products of electronic devices to be shipped among different manufactures. In the field of manufacture of liquid crystal display devices, the manufacture of liquid crystal display devices includes a process of assembling, which assembles various components, including a liquid crystal display module, a main control circuit, and an enclosure, together. These components are each manufactured in advance and packaged for being later assembled to form a complete liquid crystal display device. The liquid crystal glass, after being manufactured, is packaged in a liquid crystal glass package box and then shipped in box to a corresponding assembling station.

A flow of packaging with a conventional liquid crystal display module package structure is illustrated in FIG. 1. The package box comprises a box body 100, a bottom cushioning structure 300, and a top cushioning structure 500. The bottom cushioning structure 300 comprises a cushioning bottom board 302, two cushioning side boards 304 that are mounted on the cushioning bottom board 302 and arranged at two ends of the cushioning bottom board 302, and three positioning cushioning boards 306 that are mounted on the cushioning bottom board 302 and arranged, in a spaced manner, between the two cushioning side boards 304. The two cushioning side boards 304 are both provided with a plurality of spaced receiving slots 305. The three positioning cushioning boards 306 are all provided with a plurality of positioning slots 307 corresponding to the receiving slots 305. The top cushioning structure 500 that is used in combination with the bottom cushioning structure 300 has a structure corresponding to that of the bottom cushioning structure 300. To set up, the bottom cushioning structure 300 is first positioned in the box body 100. Next, liquid crystal display modules 700 are sequentially fit into the receiving slots 305 and the positioning slots 307. Finally, the top cushioning structure 500 is set on the tops of the liquid crystal display modules to complete packaging.

This package of liquid crystal display module comprises internal cushioning devices that are often made of a material of expandable polyethylene (EPE), which has a high cost and occupies a great amount of storage space during shipping and warehousing. Further, the number it can be recovered and reused is small. Thus, the packaging cost is greatly increased.

FIG. 2 is a schematic view showing another conventional package structure of liquid crystal display module. In this structure, top and bottom cushioning pieces 300', 500' are both made of corrugated boards. Again, this cushioning material occupies a large amount of space, which leads to a high transportation cost, thereby making the expenditure of purchasing the packaging material high. The number it can be recovered and reused is small.

FIG. 3 is a schematic view showing a further conventional package structure of liquid crystal display module. In this structure, top and bottom cushioning pieces 300", 500" are both made of Styrofoam (expandable polystyrene). Again, this cushioning material occupies a large amount of space, which leads to a high transportation cost, thereby making the expenditure of purchasing the packaging material high. The number it can be recovered and reused is small.

Thus, it is a challenge to the present inventor and those devoted themselves to the art to provide an effective liquid crystal display module packaging device that realizes reduced storage space occupied liquid crystal display module in shipping and warehousing and also overcomes high cost, complicated structure, and insignificant cushioning performance of the conventional liquid crystal display module packaging devices.

SUMMARY OF THE INVENTION

An object of the present invention is to provide a liquid crystal display module packaging structure, which receives therein a cushioning device that forms therein an accommodation space, an inflatable air cushioning body being positionable in the accommodation space of the cushioning device to support the internally-hollowed cushioning device, whereby the whole cushioning device occupies a small amount of space so as to reduce the packaging cost and thus achieving the purposes of cost saving.

To achieve the object, the present invention provides a liquid crystal display module packaging structure, which comprises a package box and a cushioning device received in the package box. The cushioning device comprises a bottom cushioning piece and a top cushioning piece used in combination with the bottom cushioning piece. The bottom cushioning piece comprises a cushioning bottom board, two cushioning side boards mounted to the cushioning bottom board and arranged at two ends of the cushioning bottom board, and three positioning boards mounted to the cushioning bottom board and arranged, in a spaced manner, between the two cushioning side boards. The cushioning side boards and the positioning boards form therein first and second accommodation spaces. The first and second accommodation spaces are filled with a plurality of inflatable cushioning bodies.

The two cushioning side boards both form a plurality of receiving slots. The three positioning boards all form a plurality of positioning slots corresponding to the plurality of receiving slots.

The two cushioning side boards and the positioning boards are fixed to the cushioning bottom board through hot pressing.

The inflatable cushioning bodies are each provided with an air-filling hole and a closure device for closing the air-filling hole.

The inflatable cushioning bodies are arranged in the first and second accommodation spaces at opposite sides thereof corresponding to the receiving slots and the positioning slots.

The package box comprises a paper box or a plastic box.

The cushioning side boards and the positioning boards are plastic products made through vacuum-forming.

The bottom cushioning piece and the top cushioning piece are of the same structure.

The present invention also provides a liquid crystal display module packaging structure, which comprises a package box and a cushioning device received in the package box, the cushioning device comprising a bottom cushioning piece and a top cushioning piece used in combination with the bottom cushioning piece, the bottom cushioning piece comprising a cushioning bottom board, two cushioning side boards mounted to the cushioning bottom board and arranged at two ends of the cushioning bottom board, and three positioning boards mounted to the cushioning bottom board and arranged, in a spaced manner, between the two cushioning side boards, the cushioning side boards and the positioning boards forming therein first and second accommodation spaces, the first and second accommodation spaces being filled with a plurality of inflatable cushioning bodies;

wherein the two cushioning side boards both form a plurality of receiving slots, the three positioning boards all forming a plurality of positioning slots corresponding to the plurality of receiving slots;

wherein the two cushioning side boards and the positioning boards are fixed to the cushioning bottom board through hot pressing;

wherein the inflatable cushioning bodies are each provided with an air-filling hole and a closure device for closing the air-filling hole;

wherein the inflatable cushioning bodies are arranged in the first and second accommodation spaces at opposite sides thereof corresponding to the receiving slots and the positioning slots.

wherein the package box comprises a paper box or a plastic box;

wherein the cushioning side boards and the positioning boards are plastic products made through vacuum-forming; and wherein the bottom cushioning piece and the top cushioning piece are of the same structure.

The efficacy of the present invention is that the present invention provides a liquid crystal display module packaging structure, which receives therein a cushioning device that forms an accommodation space and inflatable cushioning bodies are set in the accommodation space of the cushioning device to support the internally-hollowed cushioning device, which may provide an effect of fixing and protecting liquid crystal display modules, whereby during the transportation of the liquid crystal display modules, better protection can be offered to the liquid crystal display modules for preventing the products from being damaged by external forces during the transportation thereof. Further, the cushioning device of the liquid crystal display module package box according to the present invention can be repeatedly reused and occupies a reduced amount of space thereby effectively lower down the manufacture cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
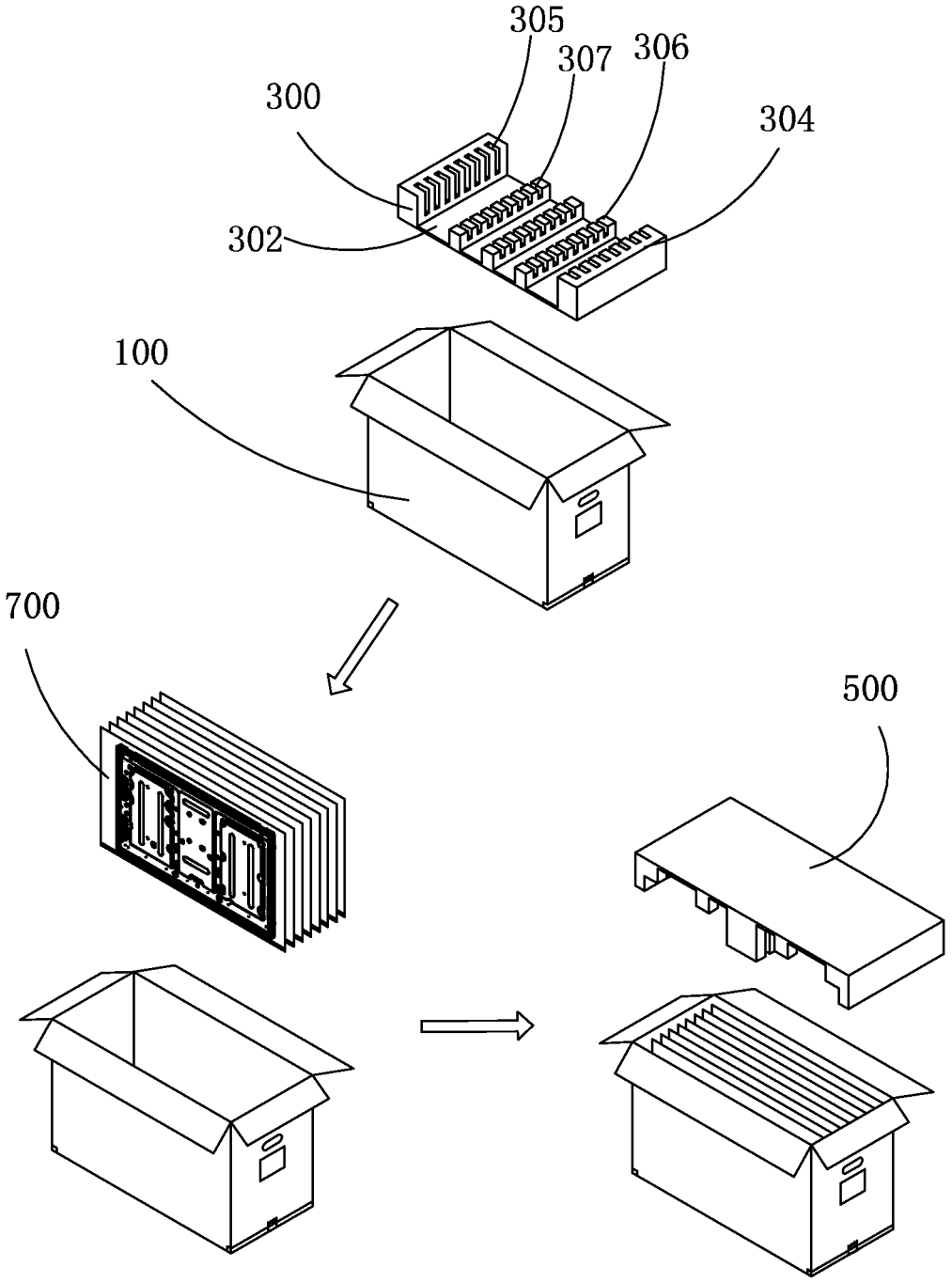
Fig. 1 (Prior Art)
FIG. 1 is a schematic view illustrating an operational flow of packaging a liquid crystal display module with a conventional packaging structure.
Figure 2:
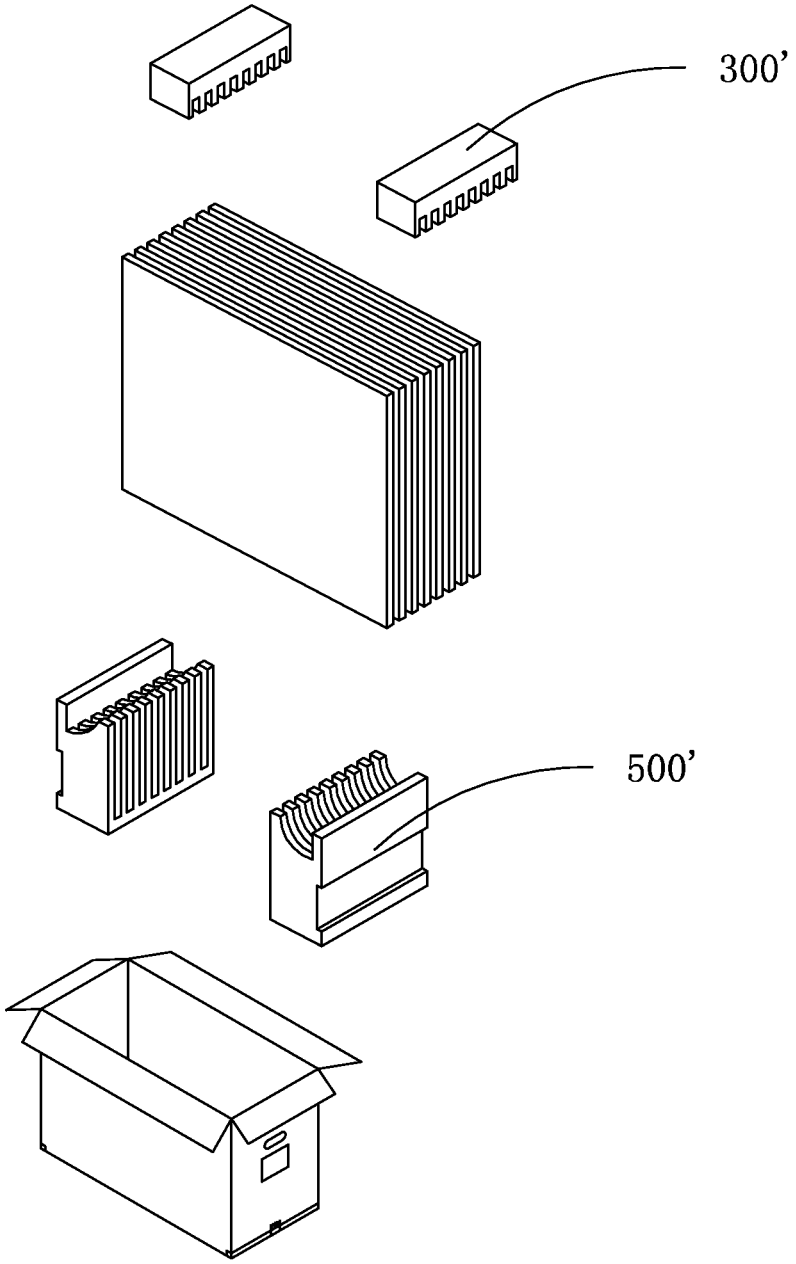
Fig. 2 (Prior Art)
FIG. 2 is a schematic view showing another conventional liquid crystal display module packaging structure.
Figure 3:
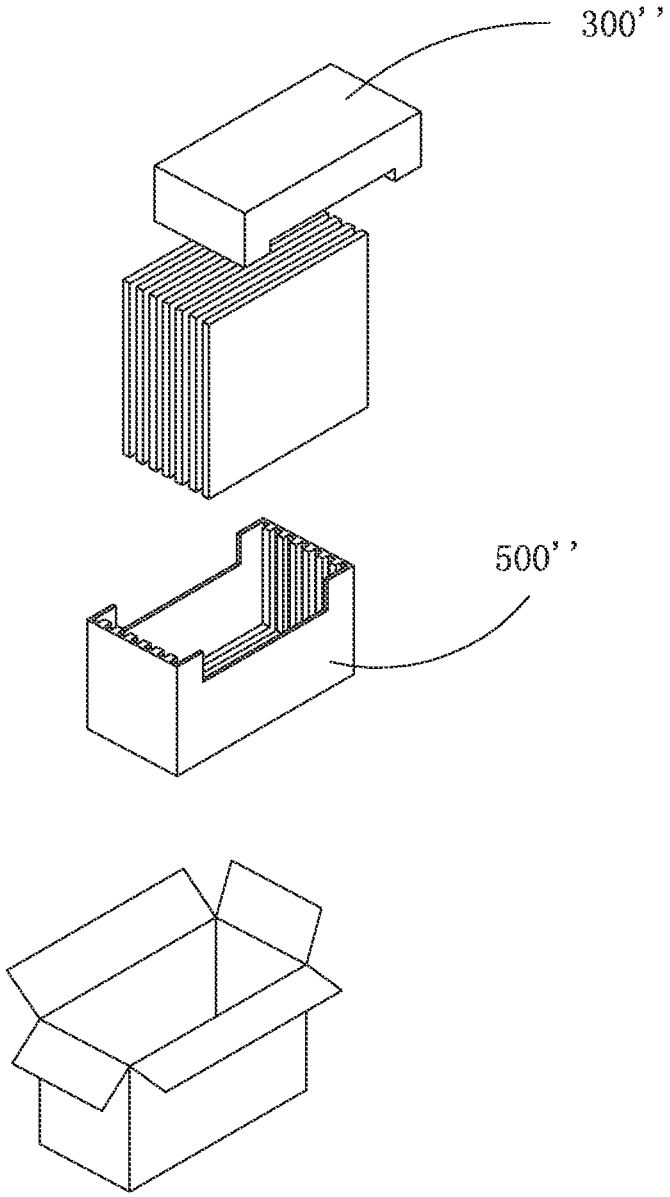
FIG. 3 is a schematic view showing a further conventional liquid crystal display module packaging structure.
Figure 4:
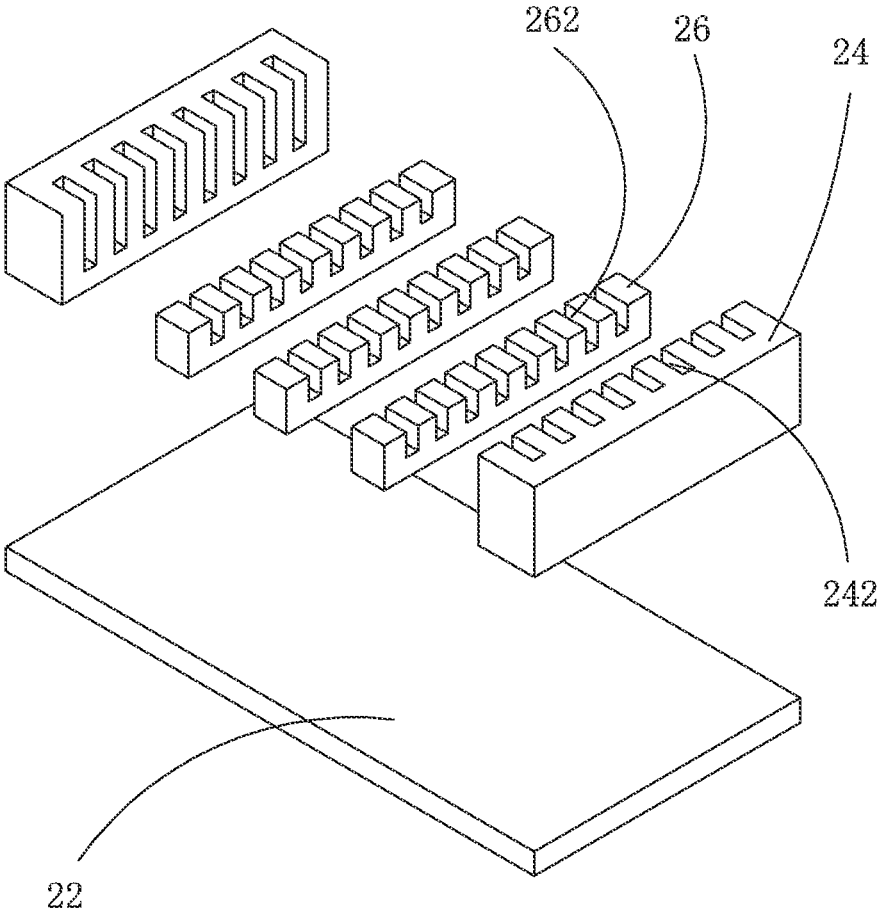
FIG. 4 is an exploded view of a bottom cushioning piece of a packaging structure of liquid crystal display module according to the present invention.
Figure 5:
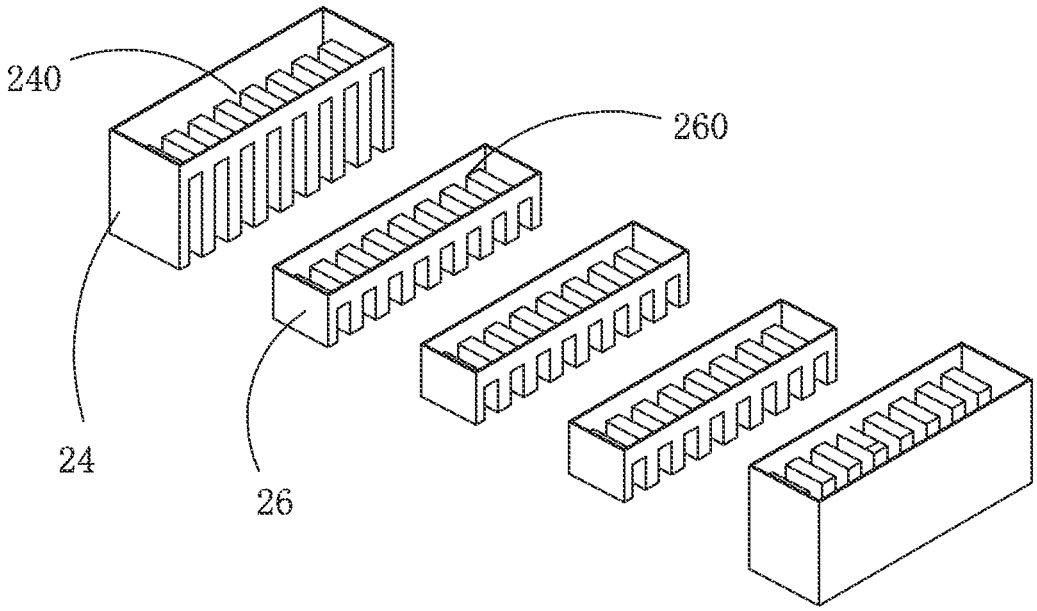
FIG. 5 is a perspective view showing the structure of cushioning side boards and positioning boards of FIG. 4.
Figure 6:
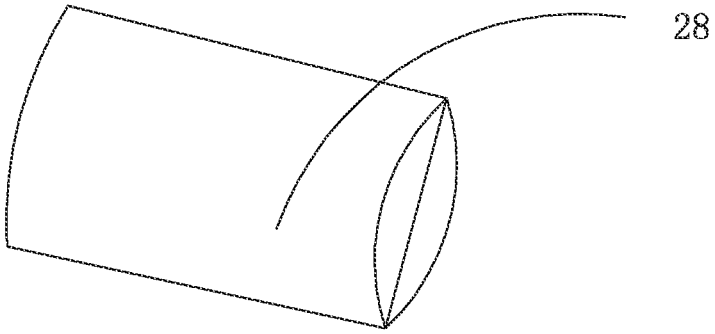
FIG. 6 is a perspective view showing an inflatable cushioning body of the packaging structure of liquid crystal display module according to the present invention.

Referring to FIGS. 4-6, the present invention provides a liquid crystal display module packaging structure, which comprises a package box (not shown) and a cushioning device received in the package box. The cushioning device comprises a bottom cushioning piece 2 and a top cushioning piece (not shown) used in combination with the bottom cushioning piece 2. The bottom cushioning piece 2 and the top cushioning piece are of the same structure.

The bottom cushioning piece 2 comprises a cushioning bottom board 22, two cushioning side boards 24 mounted to the cushioning bottom board 22 and arranged at two ends of the cushioning bottom board 22, and three positioning boards 26 mounted to the cushioning bottom board 22 and arranged, in a spaced manner, between the two cushioning side boards 24. The two cushioning side boards 24 and the positioning boards 26 are fixed to the cushioning bottom board 22 through hot pressing. The two cushioning side boards 24 both form a plurality of receiving slots 242. The three positioning boards 26 all form a plurality of positioning slots 262 corresponding to the plurality of receiving slots 242. Liquid crystal display modules are fit into the receiving slots 242 and the corresponding positioning slots 262 so as to achieve an effect of fixing and cushioning of the liquid crystal display modules.

The cushioning side boards 24 and the positioning boards 26 are plastic products made through vacuum-forming, having the advantages of light weight, ease of transportation, good sealing property, and good cushioning capability, and also has a relatively low cost, thereby lowering down the manufacture cost.

The cushioning side boards 24 and the positioning boards 26 form therein first and second accommodation spaces 240, 260. The first and second accommodation spaces 240, 260 are filled with a plurality of inflatable cushioning bodies 28. The inflatable cushioning bodies 28 are arranged in the first and second accommodation spaces 240, 260 at opposite sides thereof corresponding to the receiving slots 242 and the positioning slots 262 so as to support the cushioning device for protecting the liquid crystal display modules. The inflatable cushioning bodies 28 are each provided with an air-filling hole (not shown) and a closure device for closing the air-filling hole. To inflate, air is filled through the air-filling hole to complete the inflation of the whole device. After air filling, the air-filling hole is closed by the closure device so as to achieve an effect of cushioning. To ship the positioning and cushioning device, air contained therein can be released first to reduce the space occupation rate thereof and the lower down the shipping cost.

The inflatable cushioning bodies 28 are advantageous in that the inflatable cushioning bodies are made up of 99% air and 1% plastic film so as to show a form of a thin film before use, which is completely flat occupying almost no space thereby reducing a large amount of transportation cost and warehousing cost. They can be inflated when they are used, making the use convenient. They provide excellent resistance against shock and good protection performance. A single inflatable cushioning body may bear a weight of 60 kg without rupture so that the damage rate can be minimized. They provide excellent support and even being compressed by an external force, the inflatable cushioning body 28 may spread pressure through air cushioning to avoid damage. They are of no pollution and are environmentally friendly and recyclable.

The package box can be a paper box or a plastic box. In the instant embodiment, the plastic box is preferred. The plastic box has a better structure than a paper box, allowing repeated use without being easy broken, and is resistant to humidity and water to thereby provide improved protection. Further, repeated use of the package box further reduces the packaging cost.

To package liquid crystal display modules (not shown), the bottom cushioning piece 2 is first disposed on a bottom of the package box. Then, the liquid crystal display modules are sequentially fit into the bottom cushioning piece 2. Finally, the top cushioning piece is set on top side of the liquid crystal modules to complete packaging.

In summary, the present invention provides a liquid crystal display module packaging structure, which receives therein a cushioning device that forms an accommodation space and inflatable cushioning bodies are set in the accommodation space of the cushioning device to support the internally-hollowed cushioning device, which may provide an effect of fixing and protecting liquid crystal display modules, whereby during the transportation of the liquid crystal display modules, better protection can be offered to the liquid crystal display modules for preventing the products from being damaged by external forces during the transportation thereof. Further, the cushioning device of the liquid crystal display module package box according to the present invention can be repeatedly reused and occupies a reduced amount of space thereby effectively lower down the manufacture cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A liquid crystal display module packaging structure, comprising a package box and a cushioning device received in the package box, the cushioning device comprising a bottom cushioning piece and a top cushioning piece used in combination with the bottom cushioning piece, the bottom cushioning piece comprising a cushioning bottom board, two cushioning side boards mounted to the cushioning bottom board and arranged at two ends of the cushioning bottom board, and three positioning boards mounted to the cushioning bottom board and arranged, in a spaced manner, between the two cushioning side boards, each of the cushioning side boards having a bottom face that is recessed to form a hollow interior space of the cushioning side board, each of the positioning boards having a bottom face that is recessed to form a hollow interior space of the positioning board, the hollow interior spaces of the cushioning side boards and the positioning boards respectively defining first and second accommodation spaces, the first and second accommodation spaces each receiving a plurality of inflatable cushioning bodies positioned therein.

2. The liquid crystal display module packaging structure as claimed in claim 1, wherein each of the two cushioning side boards has a top in which a plurality of receiving slots is formed, the receiving slots of the two cushioning side boards corresponding to each other, each of the three positioning boards having a top in which a plurality of positioning slots is formed to respectively correspond to the plurality of receiving slots of each of the cushioning side boards.

3. The liquid crystal display module packaging structure as claimed in claim 2, wherein the inflatable cushioning bodies are arranged in the first and second accommodation spaces at opposite sides thereof corresponding to the receiving slots and the positioning slots.

4. The liquid crystal display module packaging structure as claimed in claim 1, wherein the two cushioning side boards and the positioning boards are fixed to the cushioning bottom board through hot pressing.

5. The liquid crystal display module packaging structure as claimed in claim 1, wherein the inflatable cushioning bodies are each provided with an air-filling hole and a closure device for closing the air-filling hole.

6. The liquid crystal display module packaging structure as claimed in claim 1, wherein the package box comprises a paper box or a plastic box.

7. The liquid crystal display module packaging structure as claimed in claim 1, wherein the cushioning side boards and the positioning boards are plastic products made through vacuum-forming.

8. The liquid crystal display module packaging structure as claimed in claim 1, wherein the bottom cushioning piece and the top cushioning piece are of the same structure.

9. A liquid crystal display module packaging structure, comprising a package box and a cushioning device received in the package box, the cushioning device comprising a bottom cushioning piece and a top cushioning piece used in combination with the bottom cushioning piece, the bottom cushioning piece comprising a cushioning bottom board, two cushioning side boards mounted to the cushioning bottom board and arranged at two ends of the cushioning bottom board, and three positioning boards mounted to the cushioning bottom board and arranged, in a spaced manner, between the two cushioning side boards, each of the cushioning side boards having a bottom face that is recessed to form a hollow interior space of the cushioning side board, each of the positioning boards having a bottom face that is recessed to form a hollow interior space of the positioning board, the hollow interior spaces of the cushioning side boards and the positioning boards respectively defining first and second accommodation spaces, the first and second accommodation spaces each receiving a plurality of inflatable cushioning bodies positioned therein;

wherein each of the two cushioning side boards has a top in which a plurality of receiving slots is formed, the receiving slots of the two cushioning side boards corresponding to each other, each of the three positioning boards having a top in which a plurality of positioning slots is formed to respectively correspond to the plurality of receiving slots of each of the cushioning side boards;

wherein the two cushioning side boards and the positioning boards are fixed to the cushioning bottom board through hot pressing;

wherein the inflatable cushioning bodies are each provided with an air-filling hole and a closure device for closing the air-filling hole;

wherein the inflatable cushioning bodies are arranged in the first and second accommodation spaces at opposite sides thereof corresponding to the receiving slots and the positioning slots;

wherein the package box comprises a paper box or a plastic box;

wherein the cushioning side boards and the positioning boards are plastic products made through vacuum-forming; and wherein the bottom cushioning piece and the top cushioning piece are of the same structure.

* * * * *